US011512899B2

(12) United States Patent
Kashihara et al.

(10) Patent No.: US 11,512,899 B2
(45) Date of Patent: Nov. 29, 2022

(54) BLAST FURNACE APPARATUS AND OPERATION METHOD FOR BLAST FURNACE

(71) Applicant: JFE STEEL CORPORATION, Tokyo (JP)

(72) Inventors: Yusuke Kashihara, Tokyo (JP); Yuki Okamoto, Tokyo (JP); Natsuo Ishiwata, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 58 days.

(21) Appl. No.: 17/040,977

(22) PCT Filed: Mar. 25, 2019

(86) PCT No.: PCT/JP2019/012606
§ 371 (c)(1),
(2) Date: Sep. 24, 2020

(87) PCT Pub. No.: WO2019/189034
PCT Pub. Date: Oct. 3, 2019

(65) Prior Publication Data

US 2021/0190426 A1 Jun. 24, 2021

(30) Foreign Application Priority Data

Mar. 28, 2018 (JP) ..... JP2018-062437

(51) Int. Cl.
*F27B 1/26* (2006.01)
*C21B 5/00* (2006.01)
(Continued)

(52) U.S. Cl.
CPC ..... *F27B 1/26* (2013.01); *C21B 5/003* (2013.01); *C21B 7/16* (2013.01); *C21B 7/20* (2013.01);
(Continued)

(58) Field of Classification Search
CPC ..... C21B 5/003; C21B 5/006; C21B 7/16; C21B 7/20; C21B 7/24; F27B 1/26; F27D 3/10; F27D 3/18
(Continued)

(56) References Cited

U.S. PATENT DOCUMENTS 4,197,495 A * 4/1980 Matsui ..... C21B 7/24 324/207.22
4,339,664 A * 7/1982 Wiklund ..... G01B 11/24 250/559.23
(Continued)

FOREIGN PATENT DOCUMENTS

CN 101020933 A 8/2007
CN 102864263 A 1/2013
(Continued)

OTHER PUBLICATIONS

Jun. 11, 2019, International Search Report issued in the International Patent Application No. PCT/JP2019/012606.
(Continued)

*Primary Examiner* — Scott R Kastler
*Assistant Examiner* — Michael Aboagye
(74) *Attorney, Agent, or Firm* — Kenja IP Law PC

(57) ABSTRACT

Disclosed is a blast furnace apparatus includes: a rotating chute; a plurality of tuyeres; a profile measurement device configured to measure surface profiles of a burden charged into the blast furnace through the rotating chute; and a blowing amount controller configured to control a blowing amount of at least one of hot blast or pulverized coal in each of the plurality of tuyeres, in which the profile measurement device includes: a radio wave distance meter installed on the blast furnace top and configured to measure the distance to the surface of the burden charged; and an arithmetic unit configured to derive the surface profiles of the burden on a
(Continued)

basis of distance data for the entire blast furnace related to distances to the surface of the burden obtained by scanning a detection wave of the radio wave distance meter in the blast furnace in a circumferential direction.

4 Claims, 5 Drawing Sheets

(51) Int. Cl.

| | |
|---|---|
| ***C21B 7/16*** | (2006.01) |
| ***C21B 7/20*** | (2006.01) |
| ***C21B 7/24*** | (2006.01) |
| ***F27D 3/10*** | (2006.01) |
| ***F27D 3/18*** | (2006.01) |
| ***F27D 21/02*** | (2006.01) |
| *F27D 19/00* | (2006.01) |

(52) U.S. Cl.
CPC ..... *C21B 7/24* (2013.01); *F27D 3/10* (2013.01); *F27D 3/18* (2013.01); *F27D 2019/004* (2013.01)

(58) Field of Classification Search
USPC ..... 266/44, 81, 92, 93, 94, 78, 99; 342/124; 73/290 R
See application file for complete search history.

(56) References Cited

U.S. PATENT DOCUMENTS

| | | | | | |
|---|---|---|---|---|---|
| 4,463,437 | A | * | 7/1984 | Schenck | G01J 5/026 374/126 |
| 4,747,062 | A | * | 5/1988 | Esau | G01F 23/162 73/299 |
| 5,971,286 | A | * | 10/1999 | Saxen | C21B 7/24 432/17 |
| 10,415,107 | B2 | | 9/2019 | Kayano et al. | |

FOREIGN PATENT DOCUMENTS

| | | | | | |
|---|---|---|---|---|---|
| CN | 105695652 | A | | 6/2016 | |
| JP | S5258560 | A | | 5/1977 | |
| JP | H01156411 | | * | 6/1989 | F27B 1/26 |
| JP | H01156411 | A | | 6/1989 | |
| JP | H01205007 | A | | 8/1989 | |
| JP | H05239512 | A | | 9/1993 | |
| JP | H0611328 | A | | 1/1994 | |
| JP | 2008260984 | A | | 10/2008 | |
| JP | 2010174371 | A | | 8/2010 | |
| JP | 2017150035 | A | | 8/2017 | |
| JP | 2018035398 | A | | 3/2018 | |
| KR | 1020160122179 | A | | 10/2016 | |
| RU | 2089617 | C1 | | 9/1997 | |
| WO | 2015133005 | A1 | | 9/2015 | |
| WO | 2017022818 | A1 | | 2/2017 | |

OTHER PUBLICATIONS

Mar. 11, 2021, Office Action issued by the Federal Service for Intellectual Property, Patents and Trademarks of the Russian Federation in the corresponding Russian Patent Application No. 2020134030 with English language search report.

Aug. 27, 2021, Office Action issued by the China National Intellectual Property Administration in the corresponding Chinese Patent Application No. 201980021069.3 with English language search report.

Dec. 7, 2020, the Extended European Search Report issued by the European Patent Office in the corresponding European Patent Application No. 19777414.4.

Apr. 9, 2022, Office Action issued by the Korean Intellectual Property Office in the corresponding Korean Patent Application No. 10-2020-7029742 with English language concise statement of relevance.

* cited by examiner

BLAST FURNACE APPARATUS AND OPERATION METHOD FOR BLAST FURNACE

TECHNICAL FIELD

This disclosure relates to a blast furnace apparatus and an operation method for a blast furnace using the same.

BACKGROUND

In general, in blast furnace operation, ore (which may be mixed with a part of coke) and coke are alternately charged as raw materials from the blast furnace top, and the blast furnace is filled with the raw materials with ore layers and coke layers alternately deposited on top of another. This operation of charging a set of ore and coke layers is usually called one charge, in which ore and coke are charged separately in a plurality of batches. In each batch, raw materials in a bunker provided on the blast furnace top are typically charged into the blast furnace while varying the angle of a rotating chute to obtain the desired deposit shape.

In blast furnace operation, it is important to maintain an appropriate burden distribution at the blast furnace top. If the burden distribution is inappropriate, the gas flow distribution will be uneven, the gas permeability will be reduced, and the reduction efficiency will decrease, leading to lower productivity and unstable operation. In other words, blast furnace operation can be stabilized by properly controlling the gas flow distribution.

As one of measures for controlling the gas flow distribution, a method using a bell-less charging device with a rotating chute (distributing chute) is known. In this charging device, the gas flow distribution is controlled by selecting the tilt angle and the number of rotations of the rotating chute, and by adjusting the drop positions and deposition amounts of raw materials in the blast furnace radial direction to control the burden distribution.

Regarding the control of the burden distribution, JPH1-156411A (PTL 1) proposes adjusting the amount of hot blast in accordance with the burden descent speed. In other words, it is described that the burden descent speed is measured by a plurality of stock line level meters, and controlling the opening degree of the hot blast control valves of a group of tuyeres assuming, for example, that the descent speed is slower at a higher stock line level. Specifically, the stock line level meters are placed at four locations in the north, south, east, and west of the blast furnace to measure the stock line level. As such, the number of installed stock line level meters is limited, and it is difficult to grasp the burden descent behavior in regions between the stock line level meters, leaving a problem for the operation of a blast furnace apparatus.

Similarly, JP2008-260984A (PTL 2) describes that the burden level is measured by multiple sounding level meters and the injection amount of pulverized coal is adjusted in accordance with the result. Specifically, the sounding level meters are placed at four locations on the circumference of the blast furnace to measure the burden level. Therefore, in the apparatus described in PTL 2, the number of installed sounding level meters is also limited, and it is difficult to properly grasp the burden descent behavior in regions between the sounding level meters, leaving a problem for the operation of a blast furnace apparatus.

Here, in order to grasp the burden distribution, it is effective to measure the profiles of the burden surface (raw material deposition surface) in the blast furnace. As a means for measuring the surface profiles of the blast furnace burden, for example, WO2015/133005 (PTL 3) and JP2010-174371A (PTL 4) describe that a detection wave such as a microwave is transmitted toward the surface of the blast furnace burden, the detection wave reflected by the surface of the blast furnace burden is received to measure the distance to the surface of the blast furnace burden, and the surface profiles of the blast furnace burden are obtained based on the measured distance.

However, the burden profiles are the information obtained immediately after the raw materials were charged into the blast furnace, and it is difficult to figure out the phenomenon occurring in the blast furnace from the profiles. Therefore, it is required to reflect the obtained profiles in improving the blast furnace operation.

CITATION LIST

Patent Literature

PTL 1: JPH1-156411A
PTL 2: JP2008-260984A
PTL 3: WO2015/133005
PTL 4: JP2010-174371A

SUMMARY

Technical Problem

In order to accurately perform control of the burden distribution in the blast furnace, it is necessary to accurately and promptly grasp the surface profiles of the blast furnace burden. When using the conventional measuring means of PTLs 1 and 2, however, measurement itself takes time, and in addition to being unable to perform rapid measurement, various measuring instruments must be evacuated outside the blast furnace body before charging raw materials, causing a problem of lower measurement frequency. Therefore, the information obtained from the measurement results cannot be promptly reflected in the actual operation. Furthermore, even if a specific action (burden distribution control) is taken based on the measurement results, the results cannot be confirmed promptly. That is, in the conventional measuring means, it is practically difficult to reflect the measurement results of the surface profiles of the blast furnace burden in the burden distribution control while confirming them.

In addition, the deposition process of raw materials cannot be grasped because it is not possible to measure the deposition surface of the blast furnace burden when charging raw materials.

It would thus be helpful to provide a blast furnace apparatus having a measuring means for accurately and promptly grasping the surface profiles of the blast furnace burden. It would also be helpful to provide a method of measuring surface profiles of the burden at least for each charging batch using this blast furnace apparatus, and maintaining the blast furnace operation in a stable condition in accordance with the measured surface profiles.

Solution to Problem

We thus provide the following embodiments:

Embodiment 1. A blast furnace apparatus comprising: a rotating chute configured to charge a raw material into a blast furnace from a blast furnace top; a plurality of tuyeres configured to blow hot blast and pulverized coal into the blast furnace; a profile measurement device configured to measure surface profiles of a burden charged into the blast furnace through the rotating chute; and a blowing amount controller configured to control a blowing amount of at least one of the hot blast or the pulverized coal in each of the plurality of tuyeres, wherein the profile measurement device comprises: a radio wave distance meter installed on the blast furnace top and configured to measure the distance to the surface of the burden in the blast furnace; and an arithmetic unit configured to derive the surface profiles of the burden on a basis of distance data for the entire blast furnace related to distances to the surface of the burden obtained by scanning a detection wave of the radio wave distance meter in the blast furnace in a circumferential direction.

Embodiment 2. The blast furnace apparatus according to Embodiment 1, wherein the profile measurement device further comprises an arithmetic unit configured to calculate a descent speed of the burden over an entire circumference of the blast furnace on a basis of surface profiles of the burden.

Embodiment 3. The blast furnace apparatus according to Embodiment 2, wherein the blowing amount controller is configured to adjust the blowing amount of at least one of the hot blast or pulverized coal on a basis of the descent speed of the burden.

Embodiment 4. An operation method for a blast furnace using the blast furnace apparatus as recited in Embodiment 1 in which ore and coke are charged from the rotating chute into the blast furnace, and hot blast and pulverized coal are blown into the blast furnace from the plurality of tuyeres, the operation method comprising: deriving, by the profile measurement device, surface profiles of the burden in the circumferential direction in the blast furnace; and in a case where variation in the surface profiles derived is within a predetermined range, measuring temperatures at the blast furnace top over an entire circumference of the blast furnace, selecting, on a basis of a distribution of the temperatures in the blast furnace in the circumferential direction, at least one of the plurality of tuyeres suitable for eliminating the distribution, and adjusting the blowing amount of at least one of the hot blast or pulverized coal at the selected at least one tuyere suitable for eliminating the distribution.

Embodiment 5. An operation method for a blast furnace using the blast furnace apparatus as recited in Embodiment 2 in which ore and coke are charged from the rotating chute into the blast furnace, and hot blast and pulverized coal are blown into the blast furnace from each of the plurality of tuyeres, the operation method comprising: deriving, by the profile measurement device, surface profiles of the burden in the blast furnace in the circumferential direction; and in a case where variation in the surface profiles derived is beyond a predetermined range, calculating descent speeds of the burden on a basis of the surface profiles over an entire circumference of the blast furnace, selecting, on a basis of a distribution of the descent speeds in the circumferential direction of the blast furnace, at least one of the plurality of tuyeres suitable for eliminating the distribution, and adjusting the blowing amount of at least one of hot blast or pulverized coal at the selected at least one tuyere suitable for eliminating the distribution.

Embodiment 6. The operation method for a blast furnace according to Embodiment 5, further comprising, in a case where the distribution of the descent speeds in the circumferential direction of the blast furnace has a circumferential position indicative of a descent speed having a deviation of 10% or more from an average descent speed in the circumferential direction, selecting at least one of the plurality of tuyeres suitable for suppressing the deviation, and adjusting the blowing amount of at least one of hot blast or pulverized coal at the selected at least one tuyere suitable for suppressing the deviation.

Advantageous Effect

According to the present disclosure, surface profiles of the blast furnace burden can be grasped accurately and promptly, and the operating conditions can be immediately changed based on the obtained surface profiles. Consequently, the gas flow distribution in the blast furnace can be properly controlled. For this reason, in blast furnace operation, high-reduction efficiencies of ores can be obtained while stabilizing the operation.

DETAILED DESCRIPTION

Figure 1:
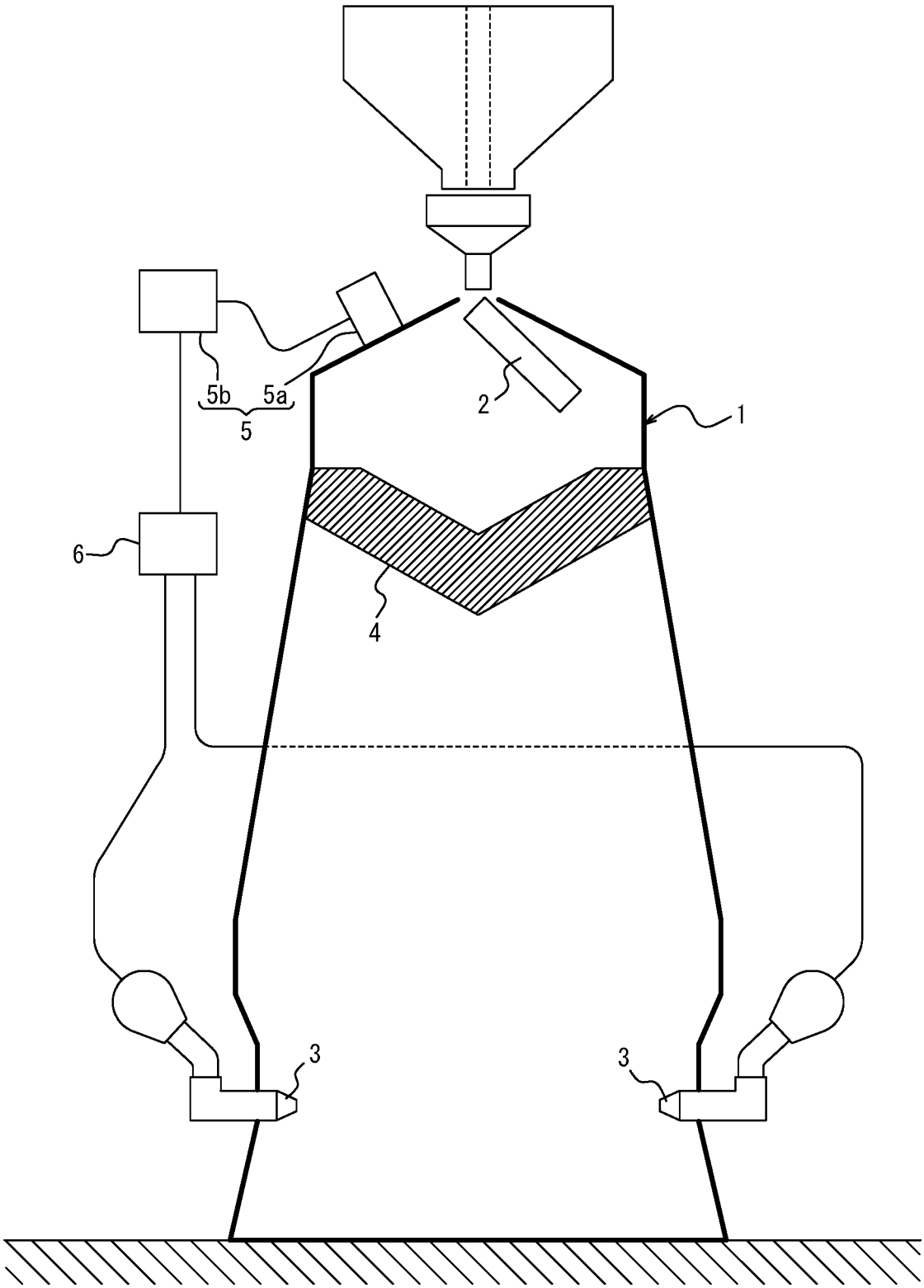
FIG. 1 illustrates a construction of a blast furnace apparatus.

Hereinbelow, a blast furnace apparatus according to the present disclosure will be described in detail with reference to FIG. 1.

Specifically, a blast furnace apparatus according to the present disclosure comprises: a rotating chute 2 configured to charge raw materials such as ore including coke into a furnace top of a blast furnace body 1; a plurality of tuyeres 3 configured to blow hot blast and pulverized coal into the blast furnace; a profile measurement device 5 configured to measure surface profiles of a burden 4 charged into the blast furnace through the rotating chute 2; and a blowing amount controller 6 configured to control a blowing amount of at least one of hot blast or pulverized coal at each of the plurality of tuyeres 3.

Here, the profile measurement device 5 has a radio wave distance meter 5*a* installed on the blast furnace top of the blast furnace body 1 to measure a distance to the surface of the burden 4 in the blast furnace, and an arithmetic unit 5*b* configured to derive surface profiles of the burden 4 on a basis of distance data for the entire blast furnace related to distances to the surface of the burden 4 obtained by scanning a detection wave of the radio wave distance meter 5*a* in a circumferential direction of the blast furnace body 1.

Figure 2:
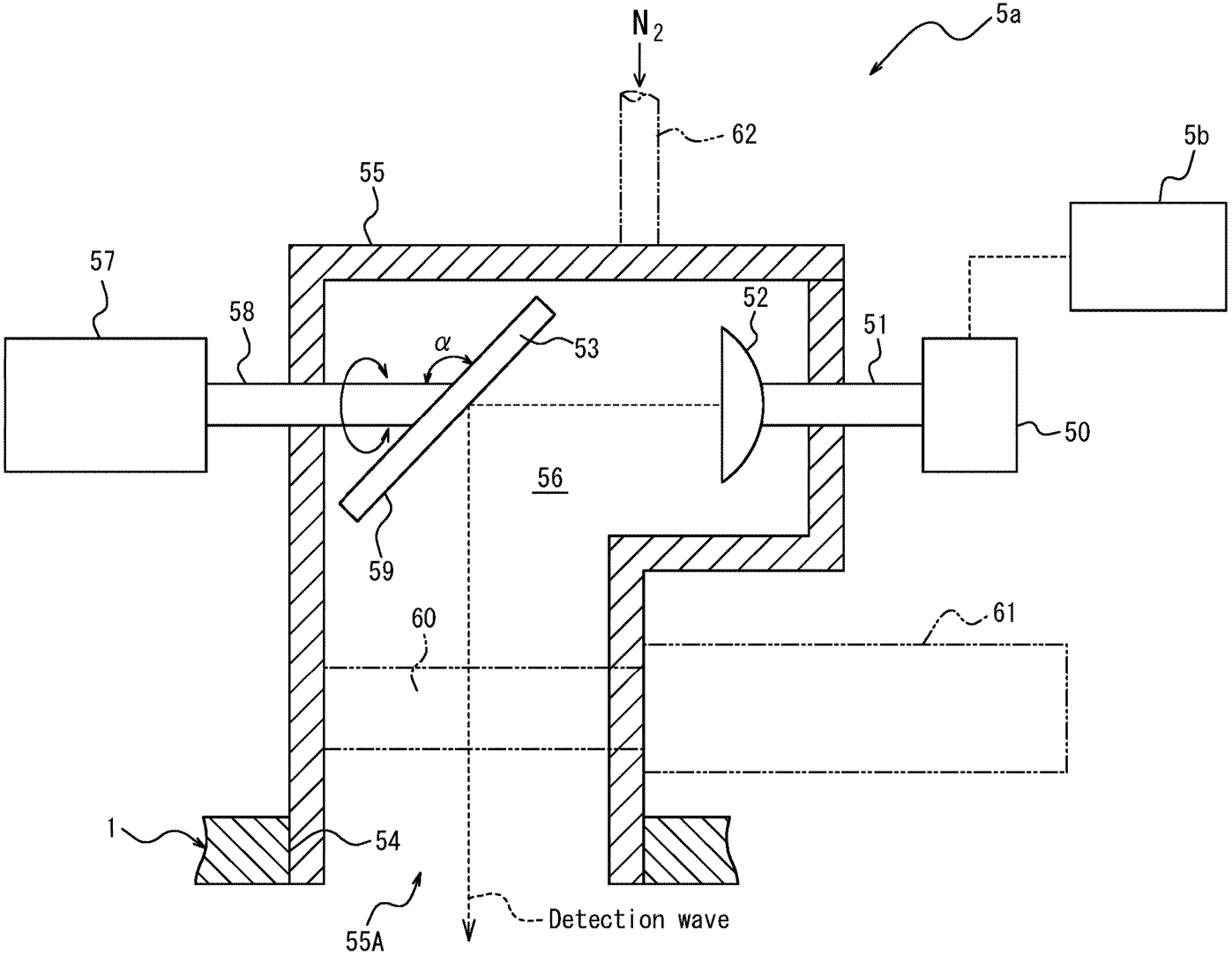
FIG. 2 illustrates a configuration of a profile measurement device.
Figure 3:
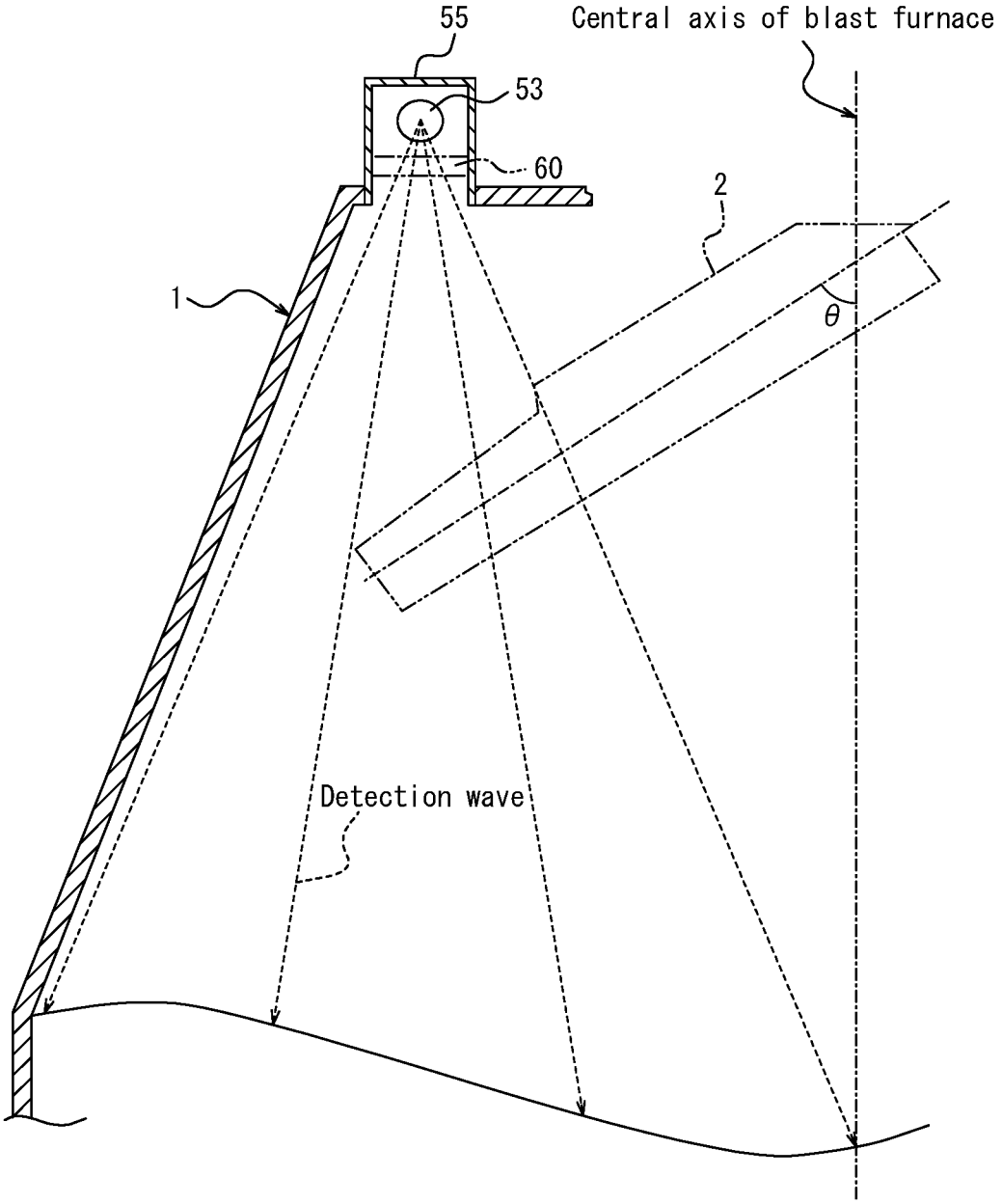
FIG. 3 illustrates an operation of a distance meter of the profile measurement device.

The distance meter 5*a* is of radio wave type and may be, for example, a device having the configuration illustrated in FIG. 2 or 3. That is, the distance meter 5*a*, as illustrated in FIG. 2, a detection wave transceiver 50 configured to transmit and receive a detection wave such as a millimeter wave or a microwave, an antenna 52 connected via a waveguide 51 to the detection wave transceiver 50, and a detection wave reflector 53 with variable reflection angles provided opposite to the antenna 52. A detection wave transmitted from the detection wave transceiver 50 and radiated from the antenna 52 is reflected by the detection wave reflector 53 to be incident on the surface of the blast furnace burden, and the detection wave reflected by the surface of the blast furnace burden is received by the detection wave transceiver 50 via the detection wave reflector 53 and the antenna 52. Then, the reflection angle of the detection wave reflector 53 is adjusted while measuring the distance to the surface of the blast furnace burden, such that the radiation of the detection wave is scanned in the blast furnace in the circumferential direction.

A window hole 54 is formed in a furnace body portion at the blast furnace top at a position where the surface of the blast furnace burden (deposition surface) can be seen downward or obliquely downward, and a casing 55 having a predetermined pressure resistance is fixedly mounted further outward than the blast furnace body so as to cover the window hole 54. The inside of the casing 55 constitutes a storage chamber 56, and the housing chamber 56 is open to the internal space of the blast furnace through the window hole 54 (thus, an opening 55A is formed). Furthermore, the antenna 52 is disposed on the inside of the storage chamber 56, and the detection wave transceiver 50 is disposed on the outside of the housing chamber 56 (outside the blast furnace body 1). The waveguide 51, which connects the detection wave transceiver 50 and the antenna 52, passes through the casing 55 and supports the antenna 52 at its tip.

Further, in the storage chamber 56, the detection wave reflector 53 is disposed so as to face the antenna 52. On the outside of the storage chamber 56 (outside the blast furnace body 1), a driver 57 that is configured to rotate the detection wave reflection 53 is disposed. The driver 57 has a rotary drive shaft 58 passing through the casing 55 and supports the detection wave reflector 53 at its tip.

Here, the positional relationship between the antenna 52, the detection wave reflector 53, and the driver 57 thereof, and the opening 55A of the storage chamber 56 satisfies the following condition: (i) an extension line of the central axis of the antenna 52 coincides with the central axis of the rotary drive shaft 58 of the driver 57; (ii) the detection wave reflector 53 is fixed to the rotary drive shaft 58 of the driver 57 at a changeable angle $\alpha$ with respect to the rotary drive shaft 58 such that it is operable to achieve linear scanning and circumferential scanning; and (iii) the antenna 52 and the detection wave reflector 53 are disposed with respect to the opening 55A such that a detection wave transmitted from the antenna 52 and reflected by the detection wave reflector 53 is guided through the opening 55A and into the blast furnace.

In addition, in order to avoid damage to a reflective surface 59 or the like by the blown up raw materials hitting the detection wave reflector 53 when the burden is blown through the interior of the blast furnace, the detection wave reflector 53 can be stopped in a rotating position such that its back side (opposite side of the reflective surface 59) faces the opening 55A while measurement is not performed.

The detection wave transceiver 50 generates a detection wave (such as a millimeter wave or a microwave) whose frequency varies continuously in time over a certain range, and is capable of transmitting and receiving the detection wave.

As the antenna 52, a parabolic antenna, a horn antenna, or the like may be used. Among these, a lensed horn antenna is particularly desirable because of its superior directional characteristics.

The detection wave reflector 53 is, for example, made of a metal material such as stainless steel, and is usually circular in shape although the shape is not limited. By rotating the detection wave reflector 53 with the rotary drive shaft 58 of the driver 57, it is possible to scan the radiation direction of the detection wave transmitted from the antenna 52 in its central axis direction and reflected by the detection wave reflector 53 in a linear fashion. Then, by changing the angle $\alpha$ between the detection wave reflector 53 and the rotary drive shaft 58, it is possible to arbitrarily change the position of the line to be scanned. Specifically, rotation of the rotary drive shaft 58 enables linear scanning in a lateral direction with respect to the direction of detection wave transmission, and a change in the angle $\alpha$ enables linear scanning in a forward and backward direction with respect to the direction of detection wave transmission. With this mechanism, by adjusting the angle of rotation of the rotary drive shaft 58 and the angle of the detection wave reflector 53 at the same time, it is possible to scan the radiation direction of the detection wave in the blast furnace in the circumferential direction.

Between the detection wave reflector 53 and the opening 55A in the housing chamber 56 (in the illustrated example, in the vicinity of opening 55A), a gate valve 60 that is configured to shut off the storage chamber 56 from the interior space of the blast furnace is provided in an open/close position. The gate valve 60 has an open/close actuator 61 that is installed on the outside of the storage chamber 56 (outside the blast furnace body 1) and that causes the gate valve 60 to slidably move to an open or close position. The gate valve 60 is opened during profile measurement and closed otherwise.

In addition, in order to prevent the gas and dust in the blast furnace from entering the storage chamber 56 during measurement and to prevent the gas in the blast furnace from leaking from the casing 55 to the outside, a gas supply pipe 62 for purge gas is connected to the casing 55, and a purge gas (usually nitrogen gas) of a predetermined pressure is supplied to the storage chamber 56 through this gas supply pipe 62.

This profile measurement device includes an arithmetic unit 5*b* that is configured to calculate a distance from the antenna 52 to the surface of the blast furnace burden based on data received and detected by the detection wave transceiver 50, and to further determine the surface profiles of the blast furnace burden from this distance data.

In the profile measurement device described above, a detection wave with a continuously changing frequency generated by the detection wave transceiver 50 is transmitted from the antenna 52 and radiated toward the surface of the blast furnace burden via the detection wave reflector 53. The detection wave reflected by the surface of the blast furnace burden (i.e., a reflected wave) is received by the detection wave transceiver 50 via the detection wave reflector 53. In the detection of the surface of the blast furnace burden using such a detection wave, by changing the reflection angle of the detection wave by causing the driver 57 to rotate the detection wave reflector 53, the radiation direction of the detection wave can be linearly scanned as illustrated in FIG. 3. At this time, by further changing the angle of the detecting wave reflector 53 and the rotary drive shaft 58, it is also possible to perform a scan in the circumferential direction of the blast furnace.

In the arithmetic unit 5*b*, the round-trip time of the detection wave from the antenna 52 to the surface of the blast furnace burden is usually determined in accordance with a frequency-modulated continuous-wave (FMCW) scheme, and the distance from the antenna 52 to the surface of the blast furnace burden is calculated. Then, surface profiles of the blast furnace burden are determined from the distance data obtained by scanning the radiation direction of the detection wave in the radial direction of the blast furnace as described above.

Furthermore, in order to scan the radiation direction of the detection wave in the circumferential direction, the mechanism for adjusting the rotation angle of the rotary drive shaft 58 and the angle of the detection wave reflector 53 may be replaced with a mechanism for rotating the entire distance meter 5*a* around the penetration direction of the opening 55A.

Also, instead of scanning the detection wave in the circumferential direction, the circumferential profiles may be obtained by determining the entire surface shape of the blast furnace burden and extracting the circumferential position information.

As described above, the distance meter 5*a* of the profile measurement device 5 for measuring the surface profiles of the blast furnace burden is a radio wave distance meter, making it possible to measure the distance to the surface of the burden 4 at least after each charging batch, and to accurately grasp the burden distribution. In particular, since measurement is available in the radial and circumferential directions of the blast furnace, the burden distribution can be accurately grasped throughout the blast furnace. In addition, it is possible to measure the burden deposition during charging of raw materials for each batch and even for each rotation of the rotating chute, and thus the burden distribution can be grasped very accurately.

Preferably, the profile measurement device 5 further comprises an arithmetic unit that is configured to calculate the descent speed of the burden 4 over the entire circumference of the blast furnace on a basis of the surface profiles of the burden 4. This arithmetic function may be assigned to the arithmetic unit 5*b*, and FIG. 1 illustrates a case where the arithmetic unit 5*b* additionally performs this arithmetic function.

Here, the descent speed of the burden can be calculated by measuring the surface profiles of the blast furnace burden 4 twice at a predetermined time interval while raw materials are not charged from the rotating chute 2, and using the distance at which the blast furnace burden has descended and the aforementioned time interval. In addition, it is preferable to obtain a burden descent speed distribution at least at four points on the circumference of the blast furnace (e.g., from four equal parts of the circumference such as east, west, south, and north to about 40 points corresponding to the number of tuyeres). However, there are a few cases where it is not possible to accurately evaluate the descent speed distribution in the circumferential direction, for example, when the descent speed changes only in a very small area in the northeast. Therefore, it is desirable to obtain a descent speed distribution that includes all descent speeds at the positions corresponding to multiple (8 to 40) tuyeres installed horizontally in the circumferential direction of the blast furnace.

Here, good data can be obtained if the predetermined time interval is within a range of a few seconds to a few minutes during normal operation. In general, the time interval between the end of charging of one batch and the start of charging of the next batch is about 1 minute to 2 minutes, during which there is no charging of raw materials from the rotating chute 2, and thus the descent speed can be obtained by making two profile measurements.

In the present disclosure, when determining the surface profiles, descent speed, and temperature distribution of the burden in the circumferential direction, the circumferential profiles, descent speed, and temperature distribution at a particular radial position are determined. The radial positions in the blast furnace are generally expressed in dimensionless radii. As used herein, a dimensionless radius is expressed as: a dimensionless radius=(a horizontal distance between a certain position in the blast furnace and the center of the blast furnace)/(a horizontal distance from the center to the inner surface of the blast furnace) in a horizontal section of the blast furnace. In the present disclosure, it is preferable to determine the surface profiles in the circumferential direction of the blast furnace at a radial position with a dimensionless radius of 0.5 to 0.95. The reason is that at a position where the dimensionless radius is smaller than 0.5, the standard deviation in the circumferential direction is less problematic, and in a region where the dimensionless radius is larger than 0.95, it is difficult to obtain reference data for the operation in a region where the dimensionless radius is larger than 0.95 because the influence of the inner wall of the blast furnace tends to be large in such region. As the radial position, it is particularly preferable to select a position with a dimensionless radius of 0.7 to 0.9.

Further, although it suffices for the blowing amount controller 6 to control the blowing amount of at least one of hot blast or pulverized coal per unit time or per unit tapping amount, it is preferable that the blowing amount controller 6 be able to control the blowing amount of both of hot blast and pulverized coal per unit time or per unit tapping amount. As used herein, the blowing amount of hot blast per unit time or per unit tapping amount is simply referred to as an amount of hot blast, and the blowing amount of pulverized coal per unit time or per unit tapping amount as an amount of pulverized coal. It is preferable to use a blowing amount controller that can adjust the amount of hot blast and/or pulverized coal in the circumferential direction of the blast furnace for each tuyere. However, it is also possible to use a blowing amount controller that enables such adjustment for each specific region for each predetermined number of tuyeres. The adjustment of the amount of hot blast and/or the amount of pulverized coal is made in accordance with the adjustment allowance determined on a basis of the data in the arithmetic unit 5*b* of the profile measurement device 5.

Next, an operation method for a blast furnace using the blast furnace apparatus illustrated in FIG. 1 will be roughly divided into operations A and B. Here, the operation method using the blast furnace apparatus illustrated in FIG. 1 basically involves at first charging ore and coke alternately from the rotating chute 2 into the blast furnace, and then blowing hot blast and pulverized coal from the tuyeres 3 into the blast furnace. This applies to both operation A and operation B described later. Further, in the basic operation of the blast furnace, the surface profiles of the burden 4 are derived by the profile measurement device 5 at least for each charging batch both in operation A and operation B. However, if the change in profile is not expected to be significant, the frequency of measurement may be reduced to one measurement in multiple batches.

[Operation A]

Now, even if surface profiles of the burden 4 are derived for each charging batch and one of the obtained surface profiles does not fluctuate in any way with respect to the previous batch, for example, and there is no bias (deviation) in the circumferential profiles, the gas distribution in the circumferential direction of the blast furnace may change. The reason is considered, for example, that if a temperature drop is observed at a specific position in the circumferential direction of the blast furnace, the reduction rate of the gas is reduced due to a decrease in the gas flow rate at that position, and the smelting reduction reaction is increased at the bottom of the blast furnace. Since this smelting reduction reaction is an endothermic reaction, it will cause a decrease in the hot metal temperature. Therefore, if there is no bias in the surface profiles, the temperature at the blast furnace top is measured over the entire circumference of the blast furnace body 1 using a thermometer. For example, the bias in the profiles may be evaluated as follows: there is no bias when the burden height or the deviation from an average value of vertical distances from the blast furnace top does not exceed a predetermined value, or when there is no point where a deviation between the measured value and the average value exceeds 3σ, for example, where a denotes a standard deviation.

The measurement results obtained are checked for the presence of a temperature distribution in the circumferential direction of the blast furnace body 1. If there is a significant distribution in temperature, the operation conditions are adjusted to eliminate the distribution. This is because the elimination of the distribution leads to correction of fluctuations in the hot metal temperature and consequently the imbalance of the gas flow distribution in the blast furnace. Specifically, at least one of the tuyeres 3 suitable for eliminating the distribution is selected and the blowing amount of at least one of hot blast or pulverized coal at the selected tuyere(s) 3 is adjusted.

The decrease in gas flow rate is often caused by the uneven flow of gas in the blast furnace. In such cases, increasing the amount of hot blast from the lower tuyere(s) in order to compensate for the decrease in the gas flow rate at a certain position is often unable to address the uneven flow. Conversely, an increase in the amount of hot blast results in an increase in coke consumption, and the descent speed of the raw materials is increased, which may cause a delay in the reduction with the gas and a larger temperature drop due to the smelting reduction. In other words, in order to eliminate the drop in hot metal temperature, it is more effective to reduce the amount of smelting reduction reaction by reducing the descending amount of raw materials. Thus, the amount of coke consumption is reduced for adjustment purposes by reducing the amount of hot blast blown through the tuyere(s) at the position where the temperature drop is confirmed, or by increasing the amount of pulverized coal. Reducing the hot blast amount will temporarily reduce the descent speed of raw materials in that area, but if the uneven flow of gas in the blast furnace is eliminated by this action, variation in the descent speed of raw materials will be often eliminated naturally. If there is a variation in the descent speed of raw materials even after the gas temperature distribution has been resolved, operation B may be taken as described below. In other words, the feature of the operation method for a blast furnace according to the present disclosure is that anomalies in the charging profile, temperature distribution, and raw material descent speed distribution are resolved by adjusting the coke consumption rate.

It is preferable to change the amount of hot blast or the amount of pulverized coal blown in from a tuyere at a position where a temperature drop has been confirmed by at least 5% of the average value of the blowing amounts from all of the tuyeres while keeping the blowing amounts from all of the tuyeres constant. The smaller the number of tuyeres used to change the amount of hot blast or the amount of pulverized coal, the smaller the operation fluctuations in the blast furnace as a whole and the more stable the operation is. The upper limit of the amount of change is preferably 20% or less. If it is desirable to increase the descending amount of raw materials, the opposite action from the above can be taken. For example, the hot blast amount can be increased to encourage coke consumption. The decision to take this action may be made, for example, when a standard deviation of measured temperatures in the circumferential direction is a, and a deviation as large as 26 or more from the mean value is observed. This standard may be modified as appropriate according to operational requirements.

As a tuyere 3 suitable for eliminating the distribution, a tuyere that is located at a position corresponding to the position where a temperature deviation has been detected in the circumferential direction of the blast furnace (i.e., at a position immediately below the position where the deviation has been detected) may be selected. In this case, a plurality of tuyere may be selected, including the tuyere immediately below and one or more other tuyeres which are located within each five tuyeres distance on both sides from the tuyere immediately below.

[Operation B]

On the other hand, when the surface profiles of the burden 4 are derived and, for example, if any of the surface profiles obtained varies from the corresponding one in the same batch in the previous charge or if there is a circumferential deviation, the amount of raw materials descending per unit time increases if there is an increase in the descent speed of the burden at a particular position in the circumferential direction of the blast furnace. As a result, the amount of smelting reduction reaction at the lower part of the blast furnace is increased, leading to a decrease in the hot metal temperature. Therefore, if there is a fluctuation or deviation in the surface profiles, the descent speed of the burden 4 is calculated from the surface profiles over the entire circumference of the blast furnace body 1 as described above. The obtained calculation results are checked for a descent speed distribution in the circumferential direction of the blast furnace body 1. The operating conditions are adjusted to eliminate the distribution. The reason is that eliminating the distribution leads to correction of fluctuations in the descent speed and thus the imbalance of the gas flow distribution in the blast furnace. Specifically, such a tuyere is selected that is suitable for eliminating a part of the distribution in which the difference in descent speed is remarkable, and the blowing amount of at least one of hot blast or pulverized coal at that tuyere is adjusted.

In other words, in order to deal with the decrease in hot metal temperature caused by the increase in the descent amount of the burden, it is effective to reduce the amount of smelting reduction reaction by reducing the descent amount of the burden. Thus, an adjustment is made to reduce the blowing amount of hot blast, or to increase the blowing amount of pulverized coal, from a tuyere at a position where an increase in the descent speed of the burden has been confirmed. In addition, when changing the amount of hot blast or pulverized coal blown in from a tuyere at a position where an increase in the descent speed has been confirmed, it is preferable to change the amount by 5% or more of the average value of the blowing amounts from all of the tuyeres while keeping the blowing amounts from all of the tuyeres constant. Again, in this case, the upper limit of the amount of change is preferably 20% or less. If it is desirable to increase the descent amount of raw materials, the opposite action from the above can be taken. It is preferable to change the condition only for a tuyere immediately below a site with a large deviation, because the smaller the number of tuyeres used to change the amount of hot blast or the amount of pulverized coal, the smaller the operating fluctuations in the blast furnace as a whole. If the deviation in the surface profiles is large or if it is desired to obtain the effect of the above-described adjustment promptly, an adjustment may be made at the same time on those in one or more tuyeres around (which are located within each five tuyeres distance on both sides from) the tuyere for which the condition is to be changed.

Thus, the use of the blast furnace apparatus according to the present disclosure is more effective in that it makes it possible to grasp the descent speed of raw materials in the circumferential direction of the blast furnace, and thus to identify the site in which a descent speed fluctuation has been detected and to change the amount of hot blast or pulverized coal blown in from an appropriate tuyere. The selection of a tuyere 3 suitable for eliminating the distribution can be made in the same manner as in operation A.

In particular, as a part of the distribution in which the difference in descent speed is significant, it is preferable to select a part where the descent speed fluctuates by 10% or more relative to the average descent speed in the circumferential direction of the blast furnace that is calculated from the results of descent speed calculation obtained in the manner as described above. This is because a descent speed fluctuation as large as 10% or more causes a remarkable decrease in the hot metal temperature.

Here, if the descent speed fluctuates by 10% or more from the average descent speed in the circumferential direction of the blast furnace (i.e., if $K \geq 0.1$, where K=|an average descent speed in the entire circumference−a descent speed in a specific site|/an average descent speed in the entire circumference), then it is preferable to change both the amount of hot blast and the amount of pulverized coal at the same time. For example, rather than doubling the amount of hot blast alone, changing both the amount of hot blast and the amount of pulverized coal can more effectively stabilize the operation because the gas permeability and the blast furnace heat can be efficiently adjusted simultaneously. In addition, such change is preferably made at a stage where K is 0.2 or less. Adjusting the amount of hot blast and the amount of pulverized coal when K exceeds 0.2 will result in large operational fluctuations and worsen air permeability. Therefore, such adjustment is preferably made at a stage where K is 0.2 or less. When K exceeds 0.2, it is preferable to reduce either or both of the amount of hot blast and the amount of pulverized coal blown in from all of the tuyeres, and to adjust the blowing amount at a specific tuyere as needed, instead of adjusting the condition of a tuyere at a specific position while keeping the amounts of hot blast and pulverized coal from all of the tuyeres constant.

In any of operations A and B described above, the amount of hot blast and the amount of pulverized coal may be changed independently or both at the same time. For example, not to mention if a drop in the hot metal temperature is observed in a specific site, if an increase in the descent speed is confirmed in a specific site, then the hot metal temperature may be lowered, and a more prompt adjustment is needed. In such a case, it is preferable to adjust the amount of hot blast. On the other hand, the hot metal temperature may increase not only when an increase in the hot metal temperature is confirmed in a specific site, but also when a decrease in the descent speed is confirmed in a specific site. In such cases, it is preferable to adjust the amount of pulverized coal as a reducing material. When the circumferential distribution returns to a normal range as a result of the above actions against the circumferential distribution anomalies, operations are performed to restore the actions, i.e., to keep the conditions of all of the tuyeres constant, while being careful not to worsen the distribution.

EXAMPLES

Example 1

The following describes operational examples in which gas flow distribution control was performed in the circumferential direction of the blast furnace according to the present disclosure. Specifically, operational tests were carried out in a large blast furnace with the structure illustrated in FIG. 1 in which 40 tuyeres were provided horizontally at equal intervals in the circumference direction of the blast furnace. The transition of various operating conditions in this operation is presented in Table 1.

Figure 4:
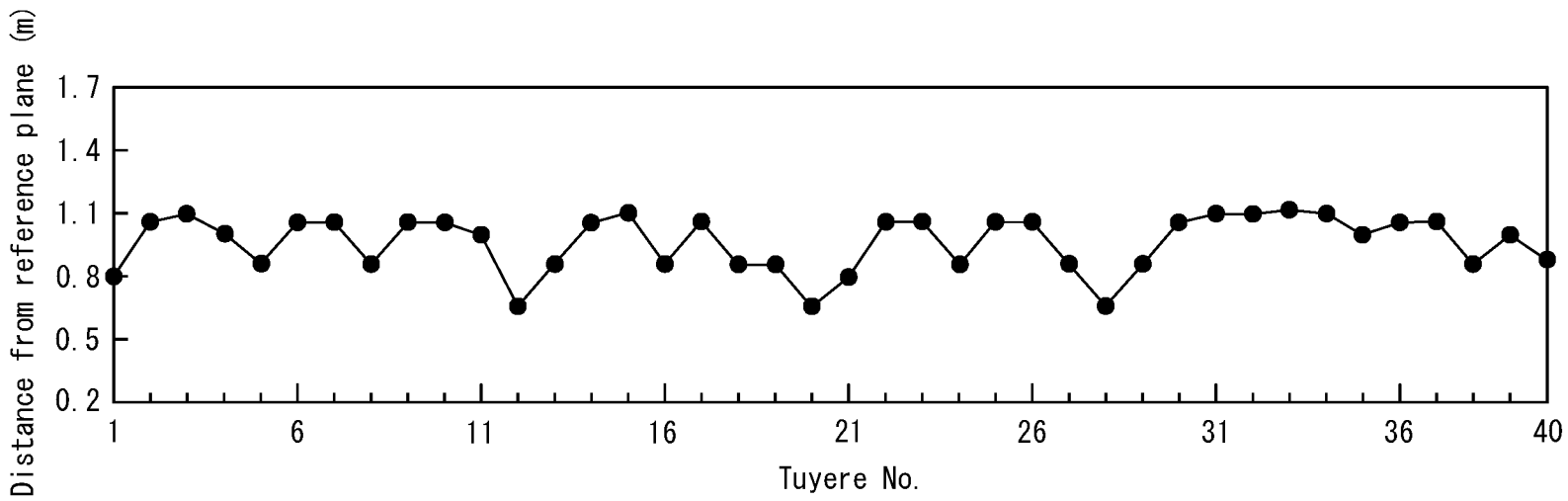
FIG. 4 illustrates surface profiles of the blast furnace burden.

In this operation, surface profiles of the burden were derived upon completion of each charging batch. At that time, the gas temperature was also measured at the blast furnace top. Measurements were made of surface profiles and gas temperatures at positions with a dimensionless radius of 0.8. Although a temperature drop was detected at the blast furnace top above No. 13 tuyere on the circumference of the blast furnace, the results of measuring surface profiles of the blast furnace burden (see FIG. 4) indicated that the standard deviation of the profiles was as small as 0.12 (m) (in this operation, 0.50 (m) or less was evaluated as falling within the normal range), and no change in the profiles was observed. Therefore, when the operation continued as it was, the hot metal temperature was lowered and the permeability resistance index was increased, and the coke ratio was increased. The blast furnace operation at this point in time is referred to as Comparative Example 1 (similarly, a subsequent blast furnace operation at each point in time will be referred to as a comparative example or an example).

Table 1 lists the temperatures at four locations in the blast furnace top as the temperatures in the inner circumferential direction of the blast furnace. In this table, the temperature at an anomalous site refers to the temperature directly above No. 13 tuyere where a temperature drop was observed in the case of Comparative Example 1, and the temperatures at the blast furnace top at the positions 90° away (No. 23 tuyere), 180° away (No. 33 tuyere), and 270° away (No. 3 tuyere) in the direction of increasing tuyere numbers are also listed in the table. In our examples, the table lists the observed values at the same positions as in the corresponding comparative examples before taking the action according to the present disclosure (the definition of tuyere positions in this table also applies to Tables 2 to 4).

Then, an operation was carried out in which the amount of hot blast blown in from a total of 11 tuyeres including No. 13 tuyere and five tuyeres on each side (i.e., Nos. 8 to 18 tuyeres) was reduced by 5% of the average amount of hot blast per tuyere, and the amount of hot blast blown in from the remaining tuyeres was increased evenly, without changing the total amount of hot blast (blast volume). As a result, the temperature drop at the position of No. 13 tuyere at the blast furnace top was compensated, and the hot metal temperature was also raised. In addition, it was possible to continue the operation with a stable permeability resistance index and to reduce the coke ratio (Example 1).

Further, from the state of Example 1, only No. 13 tuyere transitioned to a state of reducing the amount of hot blast to be blown in by 5% (Example 2). In Example 2, the temperature at the position of No. 13 tuyere where a temperature anomaly occurred was almost unchanged from Example 1, and the temperature at 270° away from the anomalous site could be brought close to the average value, the temperature deviation in the circumferential direction was greatly reduced, and the permeability resistance index was further reduced. As a result, it was possible to further stabilize the operation compared with Example 1. In other words, it is presumed that only the adjustment of the blowing conditions of a single tuyere in which the temperature anomaly occurred was sufficient to correct the temperature distribution anomaly in Comparative Example 1. In about half of the cases where similar temperature anomalies occurred, the temperature anomaly could be resolved by adjusting the conditions of only one tuyere. In about half of the remaining cases, the recovery from the temperature anomaly was slow when only one tuyere was adjusted, thus the blowing conditions of a total of 2 to 11 tuyeres around that tuyere were adjusted to eliminate the temperature anomaly.

The following describes an example (Comparative Example 2) in which the circumferential temperature distribution was measured at the blast furnace top and a temperature drop was detected at the position of No. 17 tuyere when there was no significant deviation in the circumferential surface profiles as described above. After the temperature drop was detected, the amount of pulverized coal blown in from 11 tuyeres around No. 17 tuyere was increased by 5%. As a result, the temperature drop at the position of No. 17 tuyere at the blast furnace top was compensated, the hot metal temperature was raised, and the coke ratio could be reduced (Example 3).

Similarly, in an example in which a temperature drop was detected at the position of No. 30 tuyere (Comparative Example 3), the temperature drop was also addressed by increasing the amount of pulverized coal blown in from a single No. 30 tuyere by 5% (Example 4). In this example, fewer operational actions were required, which resulted in a much smaller temperature deviation in the circumferential direction and a further reduction in the permeability resistance index, resulting in a more stable operation. The hot metal temperature could also be increased (Example 4).

TABLE 1

| Item | Unit | Comparative Example 1 | Example 1 | Example 2 | Comparative Example 2 | Example 3 | Comparative Example 3 | Example 4 |
|---|---|---|---|---|---|---|---|---|
| Production | t/d | 10032 | 10033 | 10035 | 10032 | 10034 | 10032 | 10035 |
| Coke ratio | kg/t | 334 | 329 | 323 | 332 | 328 | 332 | 322 |
| Pulverized coal ratio | kg/t | 170 | 170 | 170 | 170 | 170 | 170 | 170 |
| Blast volume | $Nm^3$/min | 6904 | 6904 | 6904 | 6904 | 6904 | 6904 | 6904 |
| Oxygen enrichment rate | % | 4 | 4 | 4 | 4 | 4 | 4 | 4 |
| Blast temp. | ° C. | 1191 | 1191 | 1191 | 1191 | 1191 | 1191 | 1191 |
| Blast moisture | g/$Nm^3$ | 20 | 20 | 20 | 20 | 20 | 20 | 20 |
| Permeability resistance index | — | 2.89 | 2.83 | 2.77 | 2.86 | 2.82 | 2.85 | 2.76 |
| Hot metal temp. | ° C. | 1492 | 1502 | 1502 | 1495 | 1503 | 1496 | 1503 |
| Temp. at blast furnace top (at anomalous site) | ° C. | 137 | 151 | 150 | 135 | 151 | 136 | 151 |
| Temp. at blast furnace top (90° away from anomalous site) | ° C. | 149 | 151 | 151 | 149 | 148 | 149 | 151 |
| Temp. at blast furnace top (180° away from anomalous site) | ° C. | 153 | 149 | 152 | 152 | 149 | 151 | 153 |
| Temp. at blast furnace top (270° away from anomalous site) | ° C. | 156 | 158 | 153 | 155 | 155 | 154 | 152 |
| Adjustment of the amount of hot blast | — | None | Reduction by 5% for each of a total of 11 tuyeres around the anomalous tuyere. | Reduction by 5% only for the anomalous tuyere. | None | None | None | None |
| Adjustment of the amount of pulverized coal | — | None | None | None | None | Reduction by 5% for each of a total of 11 tuyeres around the anomalous tuyere. | None | Increase by 5% for only the anomalous tuyere. |

Example 2

The following describes operational examples in which the gas flow distribution in the circumferential direction of the blast furnace was controlled according to the present disclosure. Specifically, operational tests were carried out in a large blast furnace with the structure illustrated in FIG. 1 in which 40 tuyeres were provided horizontally at equal intervals in the circumference direction of the blast furnace. The transition of various operating conditions in this operation is presented in Table 2.

Figure 5:
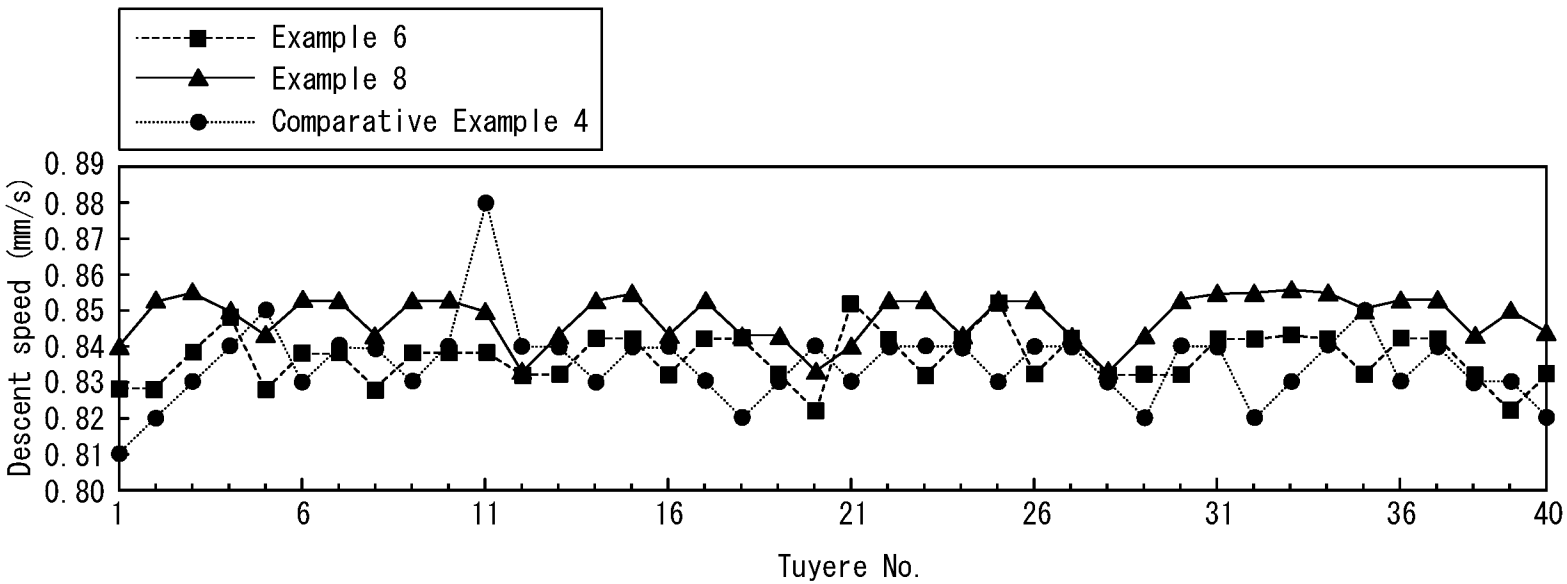
FIG. 5 illustrates the results of descent speed calculation in the circumferential direction of the blast furnace.

In this operation, the surface profiles were derived upon completion of of each charging batch at a dimensionless radius of 0.8. Since the surface profiles fluctuated between batches, the descent speed of the burden in the circumferential direction of the blast furnace was calculated from the results of surface profile measurement. From the results listed in FIG. 5, it can be seen that the hot metal temperature decreased when the operation was continued as it was even though the descent speed of the burden at the position of No. 11 tuyere had increased (Comparative Example 4).

When the amount of hot blast blown in from 11 tuyeres (Nos. 6 to 16) in the region around No. 11 tuyere where an increase in the descent speed had been detected was reduced by 5%, the increase in the descent speed at the position of No. 11 tuyere was compensated and the hot metal temperature was also raised. In addition, it was possible to continue the operation with a stable permeability resistance index and to reduce the coke ratio (Example 5). However, this method resulted in an inefficient operation because the amount of hot blast was adjusted even at those tuyeres located in a region other than the position of No. 11 tuyere.

Furthermore, since the present disclosure enables measurement of the descent speed in the entire circumference (see FIG. 5), following the state of Example 5, when the amount of hot blast blown in from No. 11 tuyere corresponding to the site where the descent speed actually decreased was reduced by 5%, fewer operational actions were needed to address the decrease in descent speed. Accordingly, the deviation in the descent speed in the circumference direction of the blast furnace was greatly reduced, and the permeability resistance index and coke ratio were further reduced. As a result, it was possible to further stabilize the operation and to raise the hot metal temperature (Example 6). In about 70% of the cases in which similar descent speed anomalies occurred, the anomalies were resolved by adjusting only one tuyere alone after the anomalies were observed. In the remaining cases, the recovery was slow due to the adjustment of only one tuyere. Thus, the blowing conditions of a total of 2 to 11 tuyeres around that tuyere were adjusted to resolve the anomalies. In many cases, the effect of adjusting the amount of hot blast or the amount of pulverized coal blow in from the tuyeres becomes noticeable within about 3 hours after the condition change. Therefore, it is preferable to take further adjustment actions if the effect is not apparent or insufficient after about 4 hours of the adjustment of conditions.

The following describes another example (Comparative Example 5) in which an increase in the descent speed of the burden was detected at the position of No. 11 tuyere as in Comparative Example 4. After detecting an increase in the descent speed, the amount of pulverized coal blown in from a total of 11 tuyeres around No. 11 tuyere (i.e., Nos. 6 to 16 tuyeres) was increased by 5%, and the increase in the descent speed at the position of No. 11 tuyere was compensated, the hot metal temperature was raised, and the coke ratio could be reduced (Example 7). However, this method resulted in an inefficient operation because the amount of pulverized coal was adjusted even at those tuyeres in a region other than the position of No. 11 tuyere.

As in Example 6, when the amount of pulverized coal blown in from No. 11 tuyere corresponding to the site where the descent speed decreased was increased by 5% following the state of Example 7, fewer operational actions were needed to address the decrease in descent speed. Accordingly, the deviation in the descent speed in the circumferential direction was greatly reduced, and the permeability resistance index and coke ratio were further reduced. As a result, it was possible to further stabilize the operation and to raise the hot metal temperature (Example 8). The descent speed distribution after the adjustment in Example 8 is also presented in FIG. 5.

PTL 1 describes a method of performing an adjustment to reduce the amount of hot blast at a higher stock line level, i.e., at a higher position in the blast furnace where the top surface of the raw materials is located, assuming that the descent speed is slower at a higher stock line level. However, measurement is performed only for the stock line level, not for the actual descent speed of raw materials. For example, even when the stock line level is high at a certain position, if the descent speed of raw materials at that position is high, stock line anomalies will eventually be resolved. In addition, even when the stock line is partially elevated, problems such as a drop in hot metal temperature are unlikely to occur if the descent speed of raw materials is uniform throughout the blast furnace. Although the actions described in PTL 1 may be effective when the pressure of the gas rising through the blast furnace is excessively high and hinders the descent of raw materials, the method of PTL 1 cannot be considered as a technique for monitoring and controlling the descent speed of the raw materials, which is a feature of the present disclosure. In this respect, the method of PTL 1 is insufficient for maintaining a stable blast furnace operation.

TABLE 2

| Item | Unit | Comparative Example 4 | Example 5 | Example 6 | Comparative Example 5 | Example 7 | Example 8 |
|---|---|---|---|---|---|---|---|
| Production | t/d | 10121 | 10122 | 10131 | 10121 | 10125 | 10122 |
| Coke ratio | kg/t | 335 | 328 | 323 | 335 | 327 | 322 |
| Pulverized coal ratio | kg/t | 170 | 170 | 170 | 170 | 170 | 170 |
| Blast volume | $Nm^3$/min | 6924 | 6924 | 6924 | 6924 | 6924 | 6924 |
| Oxygen enrichment rate | % | 4 | 4 | 4 | 4 | 4 | 4 |
| Blast temp. | ° C. | 1191 | 1191 | 1191 | 1191 | 1191 | 1191 |
| Blast moisture | g/$Nm^3$ | 20 | 20 | 20 | 20 | 20 | 20 |
| Permeability resistance index | — | 2.88 | 2.81 | 2.77 | 2.86 | 2.8 | 2.76 |
| Hot metal temp. | ° C. | 1492 | 1502 | 1502 | 1494 | 1503 | 1503 |
| Descent speed (at anomalous site) | mm/s | 0.88 | 0.85 | 0.84 | 0.87 | 0.81 | 0.85 |
| Descent speed (90° away from anomalous site) | mm/s | 0.83 | 0.85 | 0.85 | 0.82 | 0.86 | 0.84 |
| Descent speed (180° away from anomalous site) | mm/s | 0.84 | 0.86 | 0.84 | 0.84 | 0.85 | 0.85 |
| Descent speed (270° away from anomalous site) | mm/s | 0.81 | 0.83 | 0.83 | 0.82 | 0.83 | 0.84 |
| Average descent speed | mm/s | 0.84 | 0.84 | 0.84 | 0.84 | 0.84 | 0.85 |
| Adjustment of the amount of hot blast | — | None | Reduction by 5% for each of a total of 11 tuyeres around the anomalous tuyere. | Reduction by 5% only for the anomalous tuyere. | None | None | None |

TABLE 2-continued

| Item | Unit | Comparative Example 4 | Example 5 | Example 6 | Comparative Example 5 | Example 7 | Example 8 |
|---|---|---|---|---|---|---|---|
| Adjustment of the amount of pulverized coal | — | None | None | None | None | Reduction by 5% for each of a total of 11 tuyeres around the anomalous tuyere. | Increase by 5% for only the anomalous tuyere. |

Example 3

The following describes operational examples in which the gas flow distribution in the circumferential direction of the blast furnace was controlled according to the present disclosure. Specifically, operational tests were carried out in a large blast furnace with the structure illustrated in FIG. 1 in which 40 tuyeres were provided horizontally at equal intervals in the circumference direction of the blast furnace. The transition of various operating conditions in this operation is presented in Table 3.

In this operation, surface profiles of the burden were derived upon completion of each charging batch. Since the surface profiles fluctuated between batches, the descent speed of the burden in the circumferential direction of the blast furnace was calculated from the results of surface profile measurement. It can be seen from the results that the hot metal temperature decreased when the operation was continued as it was even through the descent speed of the burden at the position of No. 25 tuyere had increased 10% or higher than the average descent speed (see Table 3, Comparative Example 6).

Then, when the amount of hot blast blown in from No. 25 tuyere in the region where an increase in the descent speed had been detected was reduced by 5%, the increase in the descent speed at the position of No. 25 tuyere was compensated, the deviation in the descent speed was reduced (see Table 3), and the hot metal temperature was also raised. It was also possible to continue the operation with a stable permeability resistance index and to reduce the coke ratio (Example 9).

In addition, the adjustment of the amount of hot blast from the state of Example 9 was returned to the original state, and the blowing amount from all of the tuyeres was equalized. Subsequently, the amount of pulverized coal blown in from No. 25 tuyere located at the position corresponding to the site where the descent speed had been increased was increased by 5%. As a result, the increase in the descent speed at the position of No. 25 tuyere became smaller than that of Comparative Example 6, the deviation in the descent speed was reduced, and the hot metal temperature was also raised compared to Example 6. In addition, it was possible to continue the operation with a stable permeability resistance index and to reduce the coke ratio compared to Comparative Example 6 (Example 10).

Furthermore, the operation was carried out under the conditions that the amount of hot blast blown in from No. 25 tuyere corresponding to the site where the descent speed had been increased from the state of Example 10 was reduced by 5% and the amount of pulverized coal was increased by 5% from Comparative Example 6. As a result, the increase in the descent speed at the position of No. 25 tuyere was markedly eliminated and the deviation in the descent speed was significantly reduced (see Table 3). Consequently, the hot metal temperature was also raised, and it was possible to continue the operation with a stable permeability resistance index to significantly reduce the coke ratio (Example 11).

TABLE 3

| Item | Unit | Comparative Example 6 | Example 9 | Example 10 | Example 11 |
|---|---|---|---|---|---|
| Production | t/d | 10121 | 10115 | 10121 | 10134 |
| Coke ratio | kg/t | 335 | 330 | 330 | 322 |
| Pulverized coal ratio | kg/t | 170 | 170 | 170 | 170 |
| Blast volume | $Nm^3$/min | 6924 | 6924 | 6924 | 6924 |
| Oxygen enrichment rate | % | 4 | 4 | 4 | 4 |
| Blast temp. | ° C. | 1191 | 1191 | 1191 | 1191 |
| Blast moisture | g/$Nm^3$ | 20 | 20 | 20 | 20 |
| Permeability resistance index | — | 2.88 | 2.84 | 2.84 | 2.79 |
| Hot metal temp. | ° C. | 1492 | 1498 | 1497 | 1503 |
| Descent speed (at anomalous site) | mm/s | 0.93 | 0.9 | 0.9 | 0.86 |
| Descent speed (90° away from anomalous site) | mm/s | 0.82 | 0.84 | 0.85 | 0.84 |
| Descent speed (180° away from anomalous site) | mm/s | 0.84 | 0.85 | 0.84 | 0.85 |
| Descent speed (270° away from anomalous site) | mm/s | 0.79 | 0.81 | 0.82 | 0.84 |
| Average descent speed | mm/s | 0.85 | 0.85 | 0.85 | 0.85 |
| Adjustment of the amount of hot blast | — | None | Reduction by 5% only for the anomalous tuyere. | None | Reduction by 5% only for the anomalous tuyere. |
| Adjustment of the amount of pulverized coal | — | None | None | Increase by 5% for only the anomalous tuyere. | Increase by 5% for only the anomalous tuyere. |

Example 4

The following describes operational examples in which gas flow distribution control was performed in the circumferential direction of the blast furnace according to the present disclosure. Specifically, operational tests were carried out in a large blast furnace with the structure illustrated in FIG. 1 in which 40 tuyeres were provided horizontally at equal intervals in the circumference direction of the blast furnace. The transition of various operating conditions in this operation is presented in Table 4.

In this operation, surface profiles of the burden were derived upon completion of each charging batch. Since the surface profiles fluctuated between batches, the descent speed of the burden in the circumferential direction of the blast furnace was calculated from the results of surface profile measurement. As a result, it was detected that the descent speed at the position of No. 5 tuyere decreased (Comparative Example 7).

Accordingly, when the amount of hot blast blown in from one of the tuyeres (No. 5) in the region where a decrease in the descent speed had been detected was increased by 5%, the decrease in the descent speed in the region where the decrease in the descent speed had been detected was greatly compensated, and the deviation in the descent speed was significantly reduced (Example 12). In addition, when the condition for the amount of hot blast was returned to the original state from the state of Example 12 and the amount of pulverized coal blown in from No. 5 tuyere in the region where a decrease in the descent speed had been detected was reduced by 5%, the decrease in the descent speed at the position of No. 5 tuyere was greatly compensated, and the deviation in the descent speed was significantly reduced (Example 13). In all of our examples, the decrease in the descent speed in the northeast side was compensated, and it was possible to continue the operation with a stable permeability resistance index and to reduce the coke ratio.

REFERENCE SIGNS LIST

1 blast furnace body
2 rotating chute
3 tuyere
4 burden
5 profile measurement device
5*a* distance meter
5*b* calculator
6 blowing amount controller

The invention claimed is:

1. An operation method for a blast furnace apparatus, the blast furnace apparatus comprising:

a rotating chute configured to charge a raw material into the blast furnace from a blast furnace top;

a plurality of tuyeres configured to blow hot blast and pulverized coal into the blast furnace;

a profile measurement device configured to measure surface profiles of a burden of the raw material charged into the blast furnace through the rotating chute; and a blowing amount controller configured to control a blowing amount of at least one of the hot blast or the pulverized coal in each of the plurality of tuyeres, wherein the profile measurement device comprises:

a radio wave distance meter installed on the blast furnace top and configured to measure a distance to a surface of the burden in the blast furnace;

an arithmetic unit configured to derive the surface profiles of the burden on a basis of distance data for the entire blast furnace related to distances to the surface of the burden obtained by scanning a detection wave of the radio wave distance meter in the blast furnace in a circumferential direction; and the arithmetic unit configured to calculate a descent speed of the burden over an entire circumference of the blast furnace on a basis of the surface profiles of the burden, and

TABLE 4

| Item | Unit | Comparative Example 7 | Example 12 | Example 13 |
|---|---|---|---|---|
| Production | t/d | 10222 | 10211 | 10232 |
| Coke ratio | kg/t | 335 | 325 | 324 |
| Pulverized coal ratio | kg/t | 170 | 170 | 170 |
| Blast volume | $Nm^3$/min | 6931 | 6931 | 6931 |
| Oxygen enrichment rate | % | 4 | 4 | 4 |
| Blast temp. | ° C. | 1191 | 1191 | 1191 |
| Blast moisture | g/$Nm^3$ | 20 | 20 | 20 |
| Permeability resistance index | — | 2.88 | 2.78 | 2.78 |
| Hot metal temp. | ° C. | 1506 | 1502 | 1503 |
| Descent speed (at anomalous site) | mm/s | 0.77 | 0.83 | 0.84 |
| Descent speed (90° away from anomalous site) | mm/s | 0.82 | 0.84 | 0.85 |
| Descent speed (180° away from anomalous site) | mm/s | 0.85 | 0.84 | 0.84 |
| Descent speed (270° away from anomalous site) | mm/s | 0.83 | 0.83 | 0.83 |
| Average descent speed | mm/s | 0.84 | 0.85 | 0.85 |
| Adjustment of the amount of hot blast | — | None | Increase by 5% for only the anomalous tuyere. | None |
| Adjustment of the amount of pulverized coal | — | None | None | Reduction by 5% only for the anomalous tuyere. |

the operation method comprises:

deriving, by the profile measurement device, the surface profiles of the burden in the blast furnace in the circumferential direction;

in a case where variation in the surface profiles derived is beyond a predetermined range, calculating descent speeds of the burden on a basis of the surface profiles over an entire circumference of the blast furnace, determining a distribution of the descent speeds in the circumferential direction of the blast furnace, finding a circumferential position indicative of a descent speed having a deviation of 10% or more from an average descent speed in the circumferential direction, selecting, on a basis of the distribution of the descent speeds in the circumferential direction of the blast furnace, at least one of the plurality of tuyeres corresponding to the circumferential position and adjusting the blowing amount of at least one of hot blast or pulverized coal coming therefrom for suppressing the deviation.

2. The operation method for a blast furnace according to claim 1, further comprising, in a case where variation in the surface profiles derived is within the predetermined range, measuring temperatures at the blast furnace top over the entire circumference of the blast furnace, selecting, on a basis of a distribution of the temperatures in the blast furnace in the circumferential direction, at least one of the plurality of tuyeres, and adjusting the blowing amount of at least one of the hot blast or pulverized coal coming therefrom for eliminating the distribution of the temperatures.

3. An operation method for a blast furnace apparatus, the blast furnace apparatus comprising:

a rotating chute configured to charge a raw material into the blast furnace from a blast furnace top;

a plurality of tuyeres configured to blow hot blast and pulverized coal into the blast furnace;

a profile measurement device configured to measure surface profiles of a burden of the raw material charged into the blast furnace through the rotating chute; and a blowing amount controller configured to control a blowing amount of at least one of the hot blast or the pulverized coal in each of the plurality of tuyeres, wherein the profile measurement device comprises:

a radio wave distance meter installed on the blast furnace top and configured to measure a distance to a surface of the burden in the blast furnace;

a first arithmetic unit configured to derive the surface profiles of the burden on a basis of distance data for the entire blast furnace related to distances to the surface of the burden obtained by scanning a detection wave of the radio wave distance meter in the blast furnace in a circumferential direction; and a second arithmetic unit configured to calculate a descent speed of the burden over an entire circumference of the blast furnace on a basis of the surface profiles of the burden, and the operation method comprises:

deriving, by the profile measurement device, the surface profiles of the burden in the blast furnace in the circumferential direction;

in a case where variation in the surface profiles derived is beyond a predetermined range, calculating descent speeds of the burden on a basis of the surface profiles over an entire circumference of the blast furnace, determining a distribution of the descent speeds in the circumferential direction of the blast furnace, finding a circumferential position indicative of a descent speed having a deviation of 10% or more from an average descent speed in the circumferential direction, selecting, on a basis of the distribution of the descent speeds in the circumferential direction of the blast furnace, at least one of the plurality of tuyeres corresponding to the circumferential position and adjusting the blowing amount of at least one of hot blast or pulverized coal coming therefrom for suppressing the deviation.

4. The operation method for a blast furnace according to claim 3, further comprising, in a case where variation in the surface profiles derived is within the predetermined range, measuring temperatures at the blast furnace top over the entire circumference of the blast furnace, selecting, on a basis of a distribution of the temperatures in the blast furnace in the circumferential direction, at least one of the plurality of tuyeres, and adjusting the blowing amount of at least one of the hot blast or pulverized coal coming therefrom for eliminating the distribution of the temperatures.

* * * * *